United States Patent [19]

Hernqvist

[11] 4,285,990

[45] Aug. 25, 1981

[54] METHOD FOR COATING A SELECTED PORTION OF THE INTERNAL NECK SURFACE OF A CRT

[75] Inventor: Karl G. Hernqvist, Princeton, N.J.

[73] Assignee: RCA Corporation, New York, N.Y.

[21] Appl. No.: 172,220

[22] Filed: Jul. 25, 1980

[51] Int. Cl.[3] ..... H01J 29/00

[52] U.S. Cl. ..... 427/39; 204/192 C; 427/47; 427/68; 427/69

[58] Field of Search ..... 427/39, 47, 68, 69; 204/192 C

[56] References Cited

U.S. PATENT DOCUMENTS

| | | | |
|---|---|---|---|
| 3,355,617 | 11/1967 | Schwartz et al. | 313/82 |
| 3,758,802 | 9/1973 | Kubo et al. | 313/64 |
| 3,979,632 | 9/1976 | Gunning et al. | 313/479 |

OTHER PUBLICATIONS

Sudarshan et al., "The Effect of Chromium Oxide Coatings on Surface Flashover of Alumina Spacers in Vacuum", *IEEE Trans. on Elect. Insul.,* vol. E1-11, No. 1, Mar. 1976, pp. 32-35.

*Primary Examiner*—James R. Hoffman
*Attorney, Agent, or Firm*—E. M. Whitacre; G. H. Bruestle; L. Greenspan

[57] ABSTRACT

A method for coating a selected portion of the internal surface of the neck of a CRT having a beaded electron-gun mount assembly housed therein. The method comprises providing in the neck at least one source of chromium metal spaced from and within line-of-sight of at least a portion of the neck surface opposite each bead. The CRT is evacuated to a low gas pressure and then chromium metal vapor is released from each source towards the neck surface, whereby chromium metal deposits on the neck surface.

9 Claims, 6 Drawing Figures

METHOD FOR COATING A SELECTED PORTION OF THE INTERNAL NECK SURFACE OF A CRT

BACKGROUND OF THE INVENTION

This invention relates to a novel method for coating a selected portion of the internal neck surface of a CRT (cathode-ray tube); and particularly the internal neck surface of a CRT having a beaded mount assembly.

A color television picture tube is a CRT which comprises an evacuated glass envelope including a viewing window which carries a luminescent viewing screen, and a glass neck which houses an electron-gun mount assembly for producing one or more electron beams for selectively scanning the viewing screen. Each gun comprises a cathode and a plurality of electrodes supported as a unit in spaced tandem relation from at least two elongated, axially-oriented support rods, which are commonly referred to as "glass beads." The beads have extended surfaces closely spaced from and facing the inner surface of the glass neck. The beads usually extend from the region close to the stem, where the ambient electric fields are small, to the region of the electrode to which the highest operating potential is applied and where the ambient electric fields are high during the operation of the tube. The spaces between the beads and the neck surfaces are referred to herein as "bead channels" and are channels in which leakage currents may travel from the stem region up to the region of the highest-potential electrode. These leakage currents in the bead channels are associated with blue glow in the neck glass, with charging of the neck surface, and with arcing or flashover in the neck. The driving field for these currents is the longitudinal component of the electric field in the channel.

Several expedients have been suggested for blocking or reducing the leakage currents. Coatings on the neck glass are reported to be effective in reducing the frequency of arcing at a given voltage or increasing the voltage at which flashover occurs. For example, U.S. Pat. Nos. 3,355,617 to J. W. Schwartz et al, 3,758,802 to T. Kubo et al and 3,979,632 to E. A. Gunning disclose, for flashover reduction, the use of an internal neck coating opposite the mount assembly and composed of metal oxides or crystallized glass. Also, Dutch patent application 67-05343, published Oct. 16, 1978, discloses, for flashover reduction, the use of an internal neck coating composed of vapor-deposited chromium metal that is at least partially oxidized by heating in air. Our own experiments have shown that the minimum voltage at which flashover occurs can be materially increased by using an internal neck coating of chromium metal that has been sputter-deposited in an argon-oxygen gas mixture. Each of the above-mentioned coatings is produced before the mount assembly is installed in the neck. While they may produce the desired effect in a CRT, a simpler, more reliable and less time-consuming method is desirable for factory production of color television picture tubes.

SUMMARY OF THE INVENTION

The novel method is for coating a selected portion of the internal surface of the neck of a CRT in which an electron-gun mount assembly has been installed. The mount assembly includes at least two electrically-insulating support rods that are opposite and closely spaced from the internal neck surface, thereby defining at least two bead channels. The method comprises (a) providing in the neck at least one source of chromium metal for each of the bead channels, each source being spaced from and within line-of-sight of at least a portion of the rod-opposed neck surface, (b) evacuating the CRT to a low gas pressure, (c) and then releasing chromium metal vapor from the source into the bead channel towards the rod-opposed neck surface; whereby chromium metal deposits as a layer on the rod-opposed neck surface. Then, exhausting of the CRT is completed, and the CRT is sealed.

The chromium-metal vapor may be evaporated or sputtered from a source, such as a chromium-coated or chromium-containing carrier, which is preferably in the form of a metal strap or wire. The residual gas in the CRT during the releasing of chromium metal vapor is adapted to the particular vapor-releasing process and to modify the texture and/or the composition of the deposited layer. The presence of the deposited layer on the neck surface across the bead channel has the effect of substantially increasing the minimum voltage at which flashovers occur during the operation of the CRT.

DETAILED DESCRIPTION OF THE PREFERRED EMBODIMENT

Figure 2:
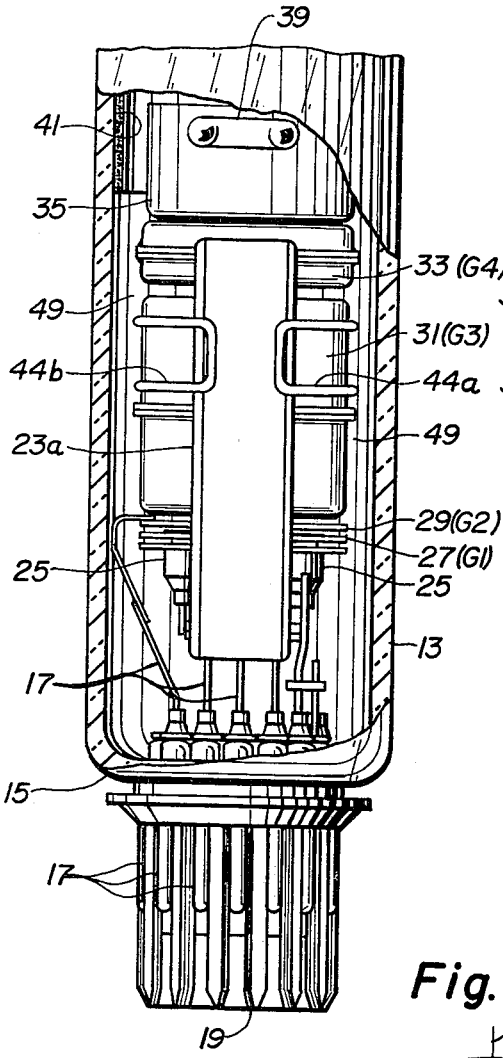
FIG. 2 is a broken-away, side, elevational view along section line 2—2 of the neck of the CRT shown in FIG. 1.
Figure 1:
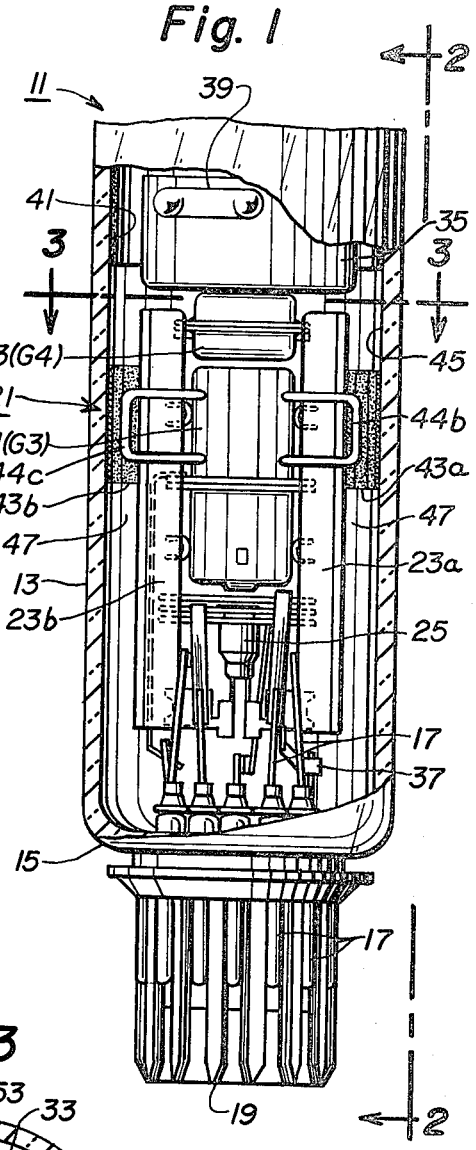
FIG. 1 is a broken-away, front, elevational view of the neck of a CRT having an internal neck coating prepared according to the novel method.
Figure 3:
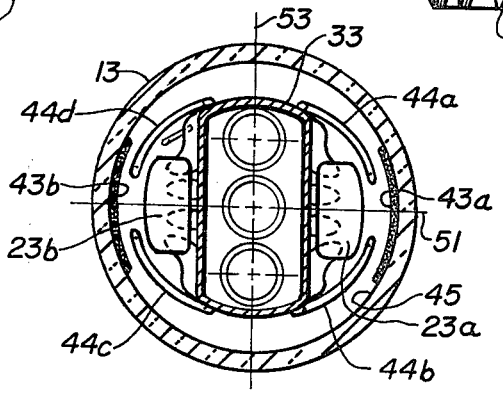
FIG. 3 is a sectional view along section line 2—2 through the neck of the CRT shown in FIG. 1.

FIGS. 1, 2 and 3 show structural details of the neck of a particular shadow-mask-type color television picture tube. The structure of this CRT, which is a rectangular 25 V size tube with 110° deflection, is conventional except for the electron-gun mount assembly and neck coating. The structural details thereof are similar to those described in U.S. application Ser. No. 078,134 filed Sept. 24, 1979 by R. H. Hughes et al. The CRT includes an evacuated glass envelope 11 comprising a rectangular faceplate panel (not shown) sealed to a funnel having a neck 13 integrally attached thereto. A glass stem 15 having a plurality of leads or pins 17 therethrough is sealed to and closes the neck 13 at the end thereof. A base 19 is attached to the pins 17 outside te envelope 11. The panel (not shown) includes a viewing window which carries on its inner surface a luminescent viewing screen comprising phosphor lines extending in the direction of the minor axis thereof, which is the vertical direction under normal viewing conditions.

An in-line beaded bipotential electron-gun mount assembly 21, centrally mounted within the neck 13, is designed to generate and project three electron beams along coplanar convergent paths to the viewing screen. The mount assembly 21 comprises first and second glass support rods or beads **23*a* and 23*b* respectively from which the various electrodes are supported to form a coherent unit in a manner commonly used in the art. These electrodes include three substantially equally transversely spaced coplanar cathodes housed in cathode sleeves 25 (one for producing each beam), a control-grid electrode (also referred to as G1) 27, a screen grid electrode (also referred to as G2), 29, a first accelerating and focusing electrode (also referred to as G3) 31, a second accelerating and focusing electrode (also referred to as G4) 33, and a shield cup 35, longitudinally spaced in that order by the beads 23***a* and 23*b*. The various electrodes of the mount assembly 21 are electrically connected to the pins 17 either directly or through metal ribbons 37. The mount assembly 21 is held in a predetermined position in the neck 13 on the pins 17 and with snubbers 39 which press on and make contact with an electrically-conducting internal coating 41 on the inside surface 45 of the neck 13. The internal coating 41 extends over the inside surface of the funnel and connects to the anode button (not shown).

Each of the beads 23*a* and 23*b* is about 10 mm (millimeters) wide by 25 mm long. Two electrically-conducting areas 43*a* and 43*b* respectively reside on those portions of the inside surface 45 of the neck 13 facing and spaced from the beads 23*a* and 23*b*. In this example, each area 43*a* and 43*b* is a coating of chromium metal that was deposited in vacuum from evaporated metal vapor after the mount assembly was assembled and installed in the CRT. As viewed in FIG. 1, each area 43*a* and 43*b* is generally oval in shape and about 15 mm high by about 10 mm wide, which is wider than the full width of the bead. Each area is about 1000 A thick except at the edges where it is tapered to a thickness of about 500 A or less. Each area is floating electrically. Each area 43*a* and 43*b* has a resistivity of about 50 ohms per square as measured with silver paste contacts applied along the upper and lower edges of the area and spaced about 12 mm apart.

The electrically-conducting areas 23*a* and 23*b* are fabricated by vapor deposition after the mount assembly 21 is installed in the neck 13. To achieve this, four sources of chromium metal are attached to the mount assembly 21 in positions that are in line-of-sight of the neck-surface areas to be coated; that is, there are no obstructions in a straight line path between each source and at least a portion of the surface area of interest that would shadow that surface area. In this embodiment, the sources are U-shaped first and second wires 44*a* and 44*b* for producing the area 43*a* and, third and fourth wires 44*c* and 44*d* for producing the area 43*b*. The ends of the first and second wires 44*a* and 44*b* are spot welded to the G3, and the cross bars of the U shape are on, or closely spaced from, the sides of the first bead 23*a*. The ends of the third and fourth wires 44*c* and 44*d* are spot welded to the G3, and the cross bars of the U shape are on, or closely spaced from, the sides of the second bead 23*b*. The wires are 20 gauge round size of a nichrome alloy, but may be of other alloys of chromium and a metal with a lower vapor pressure than chromium. The wires 44*a* to 44*d* are assembled to the mount assembly 21 prior to installing the mount assembly in the neck 13. In an alternative structure, the two pieces 44*b* and 44*c* and the two pieces 44*a* and 44*d* may each be prepared as single pieces that are spot welded to the G3.

While the CRT is being exhausted of gases, each of the wires 44*a* to 44*d* is heated to bright red heat by magnetic induction in the manner used to flash a getter. The wires may be heated simultaneously or serially in any order. In this embodiment, the induction coil (not shown) is brought close to the outside of the neck 13 opposite each wire, and about 2 kw at about 25 kilohertz is applied for 30 seconds, whereby each wire is heated to red heat, and chromium metal is evaporated from the wire. The chromium metal vapor travels in a substantially straight line and condenses as coatings 43*a* and 43*b* in a roughly oval shape. The bulk of the wires 44*a* and 44*d* remains in place after the evaporation as shown in FIGS. 1, 2 and 3. The exhausting of gases from the CRT is then completed in the normal way, and the CRT is sealed.

The tube may be operated in its normal way by applying operating voltages to the pins 17 and to the internal coating 41 through the anode button; which, for example, are typically less than 1000 volts on the G1, about 600 volts on the G2, about 5,000 volts on the G3 and about 30,000 volts on the G4. Because of the beaded structure described, the regions between the beads and the neck, which can be called the bead channels 47, behave differently from the regions between the neck and the other parts of the mount assembly, which can be called the gun channels 49. Arching (flashover), when it occurs, occurs in the bead channels 47, when the tube is operating and the conducting areas 43*a* and 43*b* are absent. However, with the conducting areas 43*a* and 43*b* present as shown in FIGS. 1, 2 and 3, arcing in these channels is substantially entirely suppressed.

Figure 4:
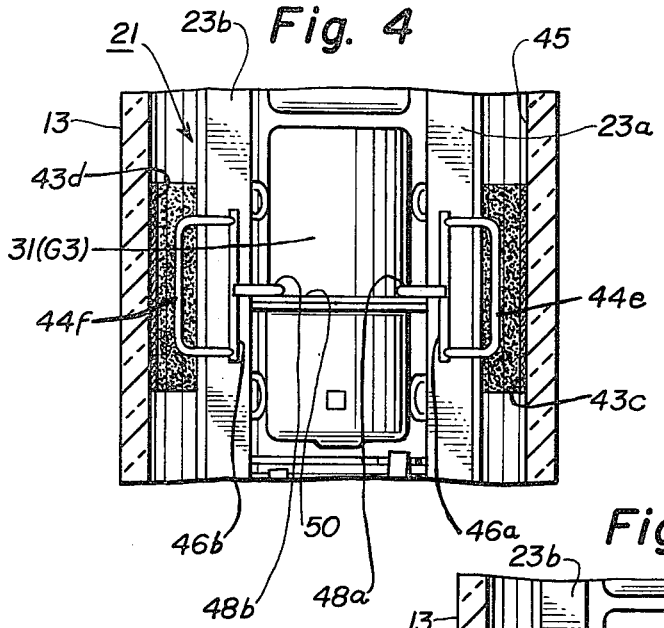
FIGS. 4, 5 and 6 are each a fragmentary elevational view of the neck of a CRT illustrating a different alternative method for practicing the novel method.

FIG. 4 shows a second embodiment of the novel method with a different support structure for the U-shaped wires than the first embodiment shown in FIGS. 1 to 3. The ends of each of the wires 44*e* and 44*f* are connected to metal support bars 46*a* and 46*b*, respectively. A metal connector 48*a* and 48*b* is spot welded at one end to about the center of each support bar 46*a* and 46*b* respectively, and at the other end thereof of the flange 50 of the G3. The U-shaped wires are of the same material, and chromium metal is evaporated thereform in the same manner as described above for the first embodiment to deposit coatings 43*c* and 43*d* opposite the beads 23*a* and 23*b* respectively. The second embodiment has the advantage over the first embodiment that the G3 and the mount assembly 21 are not as easily displaced when the chromium sources are spot welded to the G3.

Figure 5:
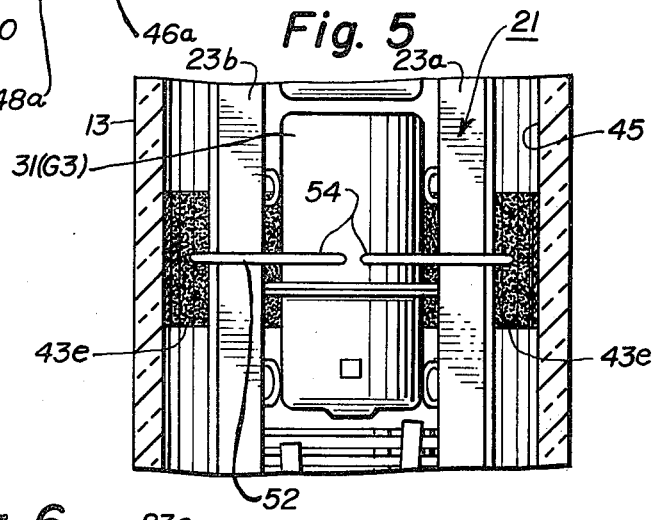

FIG. 5 shows a third embodiment wherein, instead of U-shaped wire sources, the source of chromium is a single circular wire 52 around the mount assembly 21, whose ends 54 are spot welded to the G3. The circular wire 52 is heated by magnetic induction with a coil that fits around the neck 13 in a manner similar to that which may be used for getter flashing. When the circular wire 50 is heated to red heat, chromium metal is evaporated from the wire 52 and deposits on the inside surface 45 of the neck 13 as a circular band 43*e*, part of which is opposite the beads 23*a* and 23*b*.

In addition to induction heating in a relatively high vacuum, chromium can be vaporized by sputtering in a low vacuum or preferably an argon-oxygen mixture. This also can be done during the step of exhausting gases from the CRT. This method is ideally suited for a tube having relatively large spacing between the gun and the neck glass, such as a delta-type gun.

Figure 6:
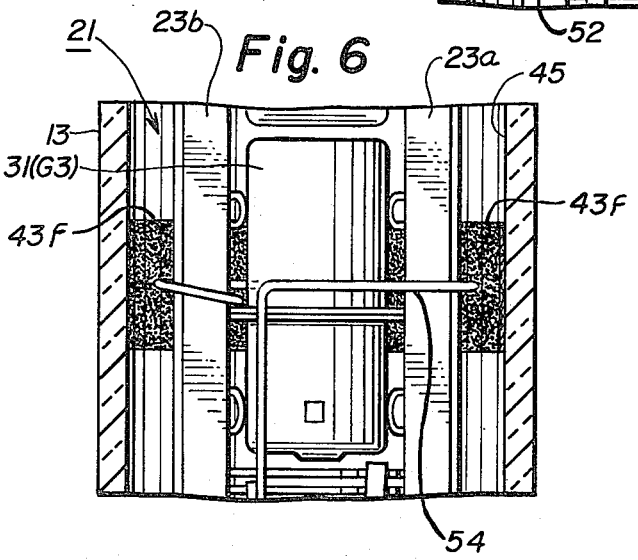

In the fourth embodiment shown in FIG. 6, a chromium-coating nichrome wire is wrapped around the gun opposite the G3 electrode and attached to a separate lead in the stem 15. During tube exhausting processing, the tube is filled with argon at a pressure of 2 torr, and a glow discharge is operated at 30 m A for 10 minutes to evaporate chromium from the wire coating. Here the coated wire serves as a cathode, and the G4 serves as an anode. A very thin neck coating 43*f* of chromium and/or chromium oxide deposits as a circular band on the inside surface 45 of the neck. The sputtering method can be applied to any of the foregoing embodiments.

Where the source is heated by magnetic induction, the heating of the internal evaporator wire is done by an RF field that is coupled through the neck glass. In cases where the evaporation temperature and the melting point of the wire are close, the danger of fusing the wire and generating metal droplets exists. Such metal particles can contribute to arcing and to blocked screen apertures in the kinescope. One solution to this problem is to use chromium-coated tungsten wires where the above-mentioned temperature difference is large. Another solution is to use a built-in tension in the evaporator wire loop, causing it to contract rather than fuse.

In the novel method, fabricating the internal neck coatings described is simple and inexpensive. These coatings are very effective for suppressing arcing and flashover during the operation of a CRT. They are recommended for use in tubes which employ a delta-type electron-gun mount assembly. Also they should allow gun operation under more severe cases such as at higher voltages and when more severe voltage gradients are present as in mount assemblies employing tripotential guns, resistive-lens guns, double bipotential guns, etc.

Also the neck coatings produced by the novel method exhibit reduced occurrences of blocked mask apertures in shadow-mask-type tubes as compared to prior particulate coatings. Two important causes of blocked apertures are particle generation at the stem, caused by spot knocking, and particle transport to the screen due to the charging of the neck glass. It has been observed that the neck coatings produced by the novel method are able to prevent arcs from forming in the stem region. Also, the low secondary electron coefficient of the coatings produced by the novel method is believed to depress the neck charging and minimize particle transport. Minimum flashover voltages of about 40 to 50 kilovolts are realized with neck coatings produced by the novel method, whereas, with no suppressor present, the minimum flashover voltage is about 20 to 35 kilovolts for a high focus voltage bipotential mount assembly in operating CRTs.

I claim:

1. A method for coating a selected portion of the internal surface of the neck of a CRT, said neck housing an electron-gun assembly including at least two electrically-insulating support rods, each of said rods having a rod surface that is opposite and closely spaced from said internal neck surface, each of said rod surfaces and the rod-opposed neck surface that is opposite thereto defining a bead channel, said method comprising (a) providing in said neck at least one source of chromium metal for each of said bead channels, each source being spaced from and within line-of-sight of at least a portion of the rod-opposed neck surface defining said channel, (b) evacuating said CRT to a low gas pressure, (c) and then releasing chromium metal vapor from said source into said bead channel towards said rod-opposed neck surface; whereby chromium metal deposits as a layer on said rod-opposed neck surface.

2. The method defined in claim 1 wherein said source is an elongated metal carrier and said chromium is released by heating said carrier to temperatures at which chromium metal has a relatively high vapor pressure.

3. The method defined in claim 2 wherein said metal carrier is heated by magnetic induction.

4. The method defined in claim 2 wherein said metal carrier is heated by ohmic resistance heating.

5. The method defined in claim 2 wherein said source is high-melting-point metal wire or strap that is coated with chromium metal.

6. The method defined in claim 2 wherein said source is a metal wire or strap composed of an alloy of chromium and at least one metal having a lower vapor pressure than chromium at said temperatures.

7. The method defined in claim 1 wherein said source is an elongated metal carrier and said chromium is released by bombarding said source with gas ions.

8. The method defined in claim 7 wherein said source is a chromium-alloy wire coated with chromium.

9. The method defined in claim 7 wherein said source is bombarded with ions of argon and oxygen produced by a glow discharge in said neck at a pressure of about 2 torr.

* * * * *

UNITED STATES PATENT AND TRADEMARK OFFICE
CERTIFICATE OF CORRECTION

PATENT NO. : 4,285,990

DATED : August 25, 1981

INVENTOR(S) : Karl Gerhard Hernqvist

It is certified that error appears in the above-identified patent and that said Letters Patent is hereby corrected as shown below:

| | |
|---|---|
| Column 3, line 28 | change "A" to --Å-- |
| Column 3, line 30 | change "A" to --Å-- |
| Column 4, line 6 | change "and" to --to-- |
| Column 4, line 33 | change "of" to --to-- |
| Column 5, line 44 | change "35" to --25-- |

Signed and Sealed this

*Tenth* Day of *November 1981*

[SEAL]

*Attest:*

GERALD J. MOSSINGHOFF

*Attesting Officer*

*Commissioner of Patents and Trademarks*